US005305769A

United States Patent [19]

Jung

[11] Patent Number: 5,305,769

[45] Date of Patent: Apr. 26, 1994

[54] DRAIN SEPARATION SYSTEM FOR POWER SPRAY PARTS WASHING MACHINE

[75] Inventor: Robert S. Jung, Pittsburgh, Pa.

[73] Assignee: American Metal Wash, Inc., Canonsburg, Pa.

[21] Appl. No.: 116,220

[22] Filed: Sep. 2, 1993

Related U.S. Application Data

[63] Continuation of Ser. No. 838,148, Feb. 18, 1992, abandoned.

[51] Int. Cl.[5] ..... B08B 3/02

[52] U.S. Cl. ..... 134/96.12; 134/198.1; 134/200; 134/111; 134/155; 134/186

[58] Field of Search ..... 134/155, 186, 111, 96.1, 134/95.1, 200, 98.1, 103.2, 97.1, 57 R, 58 R, 98.1; 68/208; 137/625.25, 625.27, 625.48, 625.47, 382, 382.5; 251/319, 143

[56] References Cited

U.S. PATENT DOCUMENTS

| | | | |
|---|---|---|---|
| 2,478,814 | 8/1949 | Ferris | 134/96.1 X |
| 2,634,735 | 4/1953 | Buck | 134/95 |
| 2,653,617 | 9/1953 | Zaber | 134/56 |
| 2,808,064 | 10/1957 | Kearney | 134/58 |
| 2,943,799 | 7/1960 | Boomer | 134/96.1 X |
| 2,994,329 | 8/1961 | Catlin et al. | 134/58 |
| 3,078,861 | 2/1963 | Miller | 134/96.1 |
| 3,173,433 | 3/1965 | Wynne et al. | 134/95.18 X |
| 3,439,689 | 4/1967 | Zardon et al. | 134/111 |
| 3,452,763 | 7/1969 | Ballard | 134/96 |
| 3,499,792 | 3/1970 | Veith | 134/99.1 X |
| 3,916,937 | 11/1975 | Nystrom | 137/255 |
| 4,073,663 | 2/1978 | Lundgren | 134/10 |
| 4,739,782 | 4/1988 | Nourie | 134/140 |
| 5,000,207 | 3/1991 | Titterington et al. | 134/155 X |

FOREIGN PATENT DOCUMENTS

| | | | |
|---|---|---|---|
| 628761 | 9/1949 | United Kingdom | 134/96.1 |

*Primary Examiner*—Frankel Stinson

*Attorney, Agent, or Firm*—Webb, Burden, Ziesenheim & Webb

[57] ABSTRACT

A power spray washing machine includes an enclosed wash cabinet positioned above a wash holding tank and a rinse holding tank. Openings are provided through a floor of the wash cabinet directly into the wash and rinse tanks, respectively. Vertical plug valves are associated with each opening to open and close the openings and control the flow of fluids therethrough. Each valve includes a first valve head moveable between a closed position in direct contact with and closing the opening and an open position out of contact with and uncovering the opening. The valve heads retain no fluid between the floor of the wash cabinet and the holding tanks when the valve head is in the closed position. By this arrangement, cross contamination of solutions between the wash and rinse holding tanks is minimized or eliminated.

16 Claims, 5 Drawing Sheets

DRAIN SEPARATION SYSTEM FOR POWER SPRAY PARTS WASHING MACHINE

This is a continuation of copending application Ser. No. 07/838,148 filed on Feb. 18, 1992, now abandoned.

BACKGROUND OF THE INVENTION

1. Field Of The Invention

This invention relates to enclosed industrial washing machines and, more particularly, to liquid or solution drain systems for power spray parts washing machines.

2. Background Of The Invention

The use of water-based power spray parts cleaning or washing machines is well known in the industry. See, for example, U.S. Pat. Nos. 2,634,735; 2,653,617; 2,808,064; 2,994,329; 3,452,763; 3,916,937; 4,073,663; and 4,739,782. In one known arrangement, a single chamber parts washing machine includes an enclosed wash cabinet having an access opening, closed by a moveable door, and one or more liquid or solution holding tanks located beneath the wash cabinet. The holding tanks can hold various washing and rinsing solutions, which may contain biodegradable detergents, rust inhibitors or the like, as desired by the particular cleaning process. The tanks generally also heat the liquid solutions contained therein. A pressurized supply of the solution is carried from a holding tank to a distribution header, including a plurality of spraying nozzles, located within the wash cabinet. The parts to be cleaned are generally positioned in a rotating holding tray and a desired liquid or solution is sprayed on the parts under high pressure. After a washing solution has been sprayed on the parts, the solution is returned to a wash holding tank for recirculation. After the parts have been washed, it is often necessary to rinse the parts. Then it becomes necessary to divert a rinsing solution either to a separate rinse holding tank beneath the wash cabinet, for recirculation, or to an outside drain as may be required by the process.

In the known arrangements for washing parts and for collecting the wash and/or rinse solutions for reuse, openings are provided in the floor of the wash cabinet and standard valving and conduits are used to collect the fluids and direct them to the appropriate solution holding tank or to an outside drain. In view of the large liquid flows involved in such a parts spray washing operation, it has been necessary to use large collection pipes which, in turn, necessitate the use of large control valves. Not only does a large control valve take considerable room in the machine, but such a valve also requires an expensive actuator for its operation. In addition, a quantity of the particular solution is collected in the piping between the control valve and the openings in the floor of the wash cabinet. When the system switches the path of the return solution flow from one holding tank to another, the remaining fluid in the piping above the valve from the previous solution process will be diverted into a different solution holding tank. Although cross contamination of the other holding tank from this excess fluid may not be substantial for any single switching operation, most parts washing machines repeatedly perform this switch over from one tank to another with the same solutions in the holding tanks. In a typical repeated switching between wash and rinse cycles, this cross contamination from the fluid collecting in the pipe ahead of the valve can build up over time and cause serious contamination problems in the separate rinse and wash solution holding tanks.

Therefore, it is an object of the present invention to provide a drain system for a power spray parts washing machine which eliminates or minimizes the cross contamination between the solution holding tanks when switching between the tanks. It is also an object of the present invention to eliminate such cross contamination of the solutions in an arrangement which is simple to use, easy to manufacture, reliable and inexpensive.

SUMMARY OF THE INVENTION

Accordingly, I have invented a power spray washing machine for cleaning parts or the like which includes an enclosed wash cabinet and at least a first liquid holding tank positioned beneath the wash cabinet. At least a first spray means sprays a first liquid within the wash cabinet and a first pump means pumps the first liquid from the first liquid holding tank into the first spray means and into the wash cabinet. A first opening is provided through a floor of the wash cabinet and in direct fluid communication with the first liquid holding tank. A first valve means controls the fluid flows through the first opening. The first valve means includes a first valve head moveable between a closed position in direct contact with and closing the first opening and an open position out of contact with and uncovering the first opening. Finally, a control means controls the operation of the first valve means between the open and closed positions. In accordance with this arrangement, the first valve head retains no fluid between the floor of the wash cabinet and the first liquid holding tank when the first valve head is in the closed position and, accordingly, minimizes or eliminates cross contamination of solutions between various liquid holding tanks.

My invention can also include additional liquid holding tanks and associated spray means, pump means, openings and valve means. In a preferred embodiment, the power spray washing machine includes a second liquid holding tank, a second spray means, a second pump means, a second opening, and a second valve means, all similar to the associated elements described above for the first liquid holding tank. It is preferred that the power spray washing machine include a liquid collection trough extending downwardly from the wash cabinet floor and having the various openings extending through a bottom wall of the trough. The trough is preferably positioned at a front portion of the wash cabinet. In this arrangement, the valve means are advantageously positioned within the trough and above the respective openings.

Each valve means can include a support positioned above and spaced from an associated opening and attached to opposed sidewalls of the trough. The valve means can include an actuator attached to a lower surface of the support and having a moveable shaft extending downwardly therefrom, with the valve head attached to an exterior end of the shaft. Preferably, the valve heads are each a flat plate, larger than the associated opening, and coated with a resilient, non-porous material on a lower face thereof which covers the associated opening. The actuator can be a pneumatic cylinder and the control means can include a pneumatic solenoid connected to a source of pressurized air and a controller directing the operation of the solenoid and the flow of pressurized air to the pneumatic cylinder. A chip strainer can be positioned over and covering an upper portion of the trough and positioned above the various valve means.

It may also be advantageous to include a third opening through the floor of the wash cabinet, or through the bottom wall of the trough, and in direct communication with a drain conduit. In this arrangement, an additional valve means controlling fluid flows through the third opening and the drain conduit would be provided.

DETAILED DESCRIPTION OF THE PREFERRED EMBODIMENTS

Figure 1:
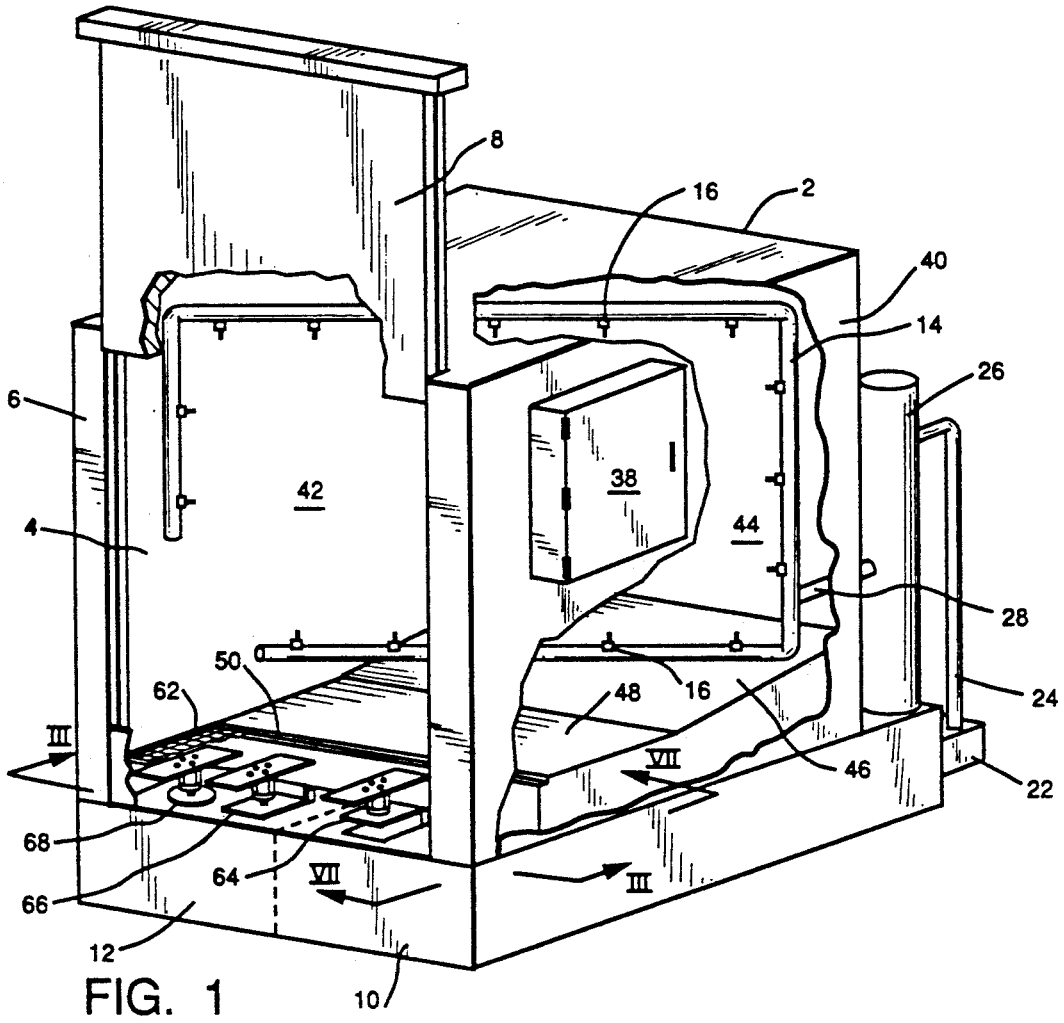
FIG. 1 is a perspective view, partially exposed, of one embodiment of a power spray parts washing machine in accordance with the present invention.
Figure 2:
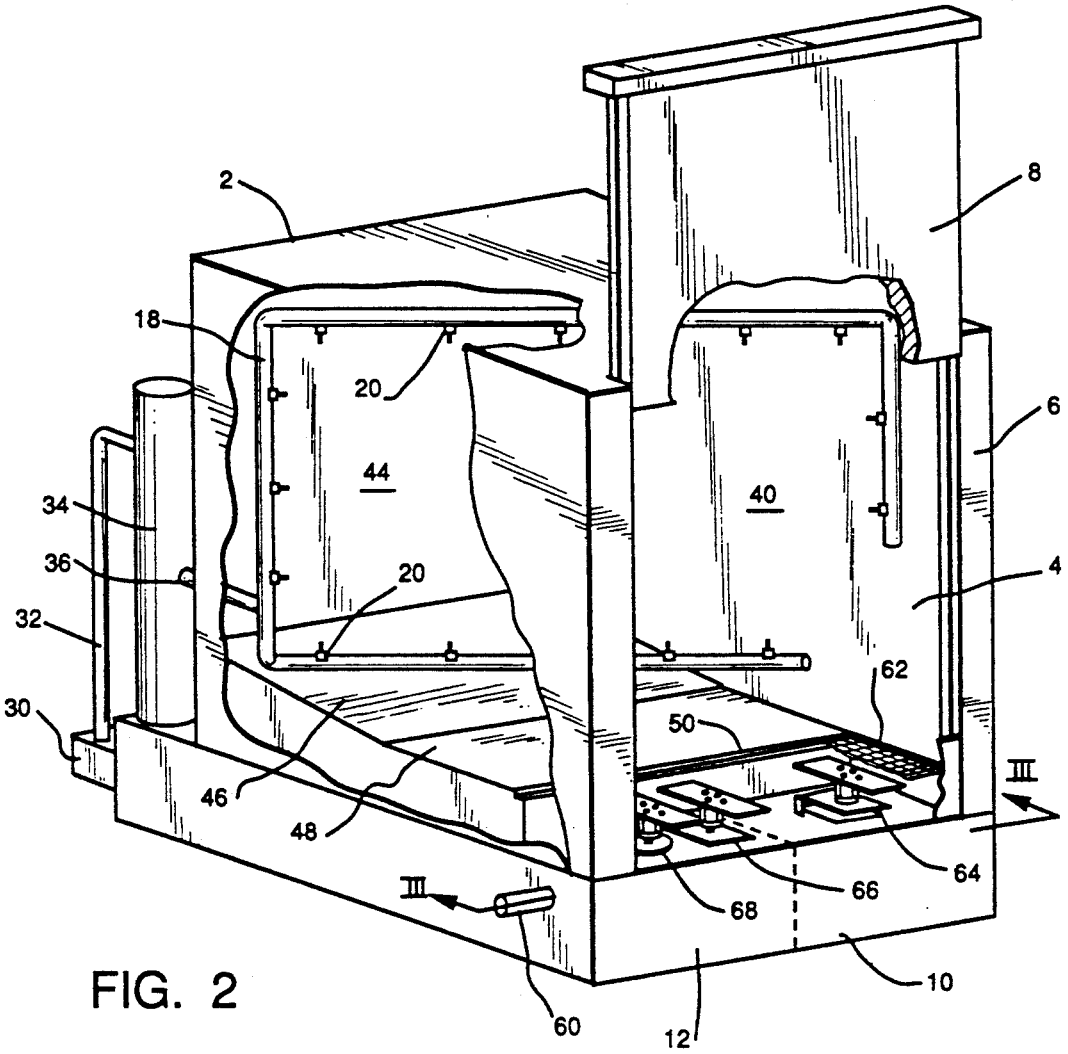
FIG. 2 is a perspective view, from another angle and partially exposed, of the power spray parts washing machine shown in FIG. 1.

One embodiment of a power spray parts washing machine in accordance with the present invention is shown in FIGS. 1-7. This machine includes an enclosed wash cabinet 2 having at least one access opening 4 therethrough, preferably through the front wall 6 of the wash cabinet 2. The access opening 4 is closed by a moveable door 8 attached to the wash cabinet 2. The wash cabinet 2 is positioned above and attached to a wash solution or liquid holding tank, hereinafter referred to as the wash tank 10, as well as to a rinse solution or liquid holding tank, hereinafter referred to as the rinse tank 12. A wash spray header 14, which is an elongated pipe, nearly rectangular in shape, and having a plurality of inwardly oriented outlet nozzles 16, is positioned within the wash cabinet 2 and extends diagonally therein from one corner to an opposite corner. Likewise, a rinse spray header 18, similar in configuration to the wash spray header 14, is positioned within the wash cabinet 2, includes a plurality of inwardly directed outlet nozzles 20, and extends diagonally within the wash cabinet 2 between the remaining corners thereof and crossing the wash header 14. A wash pump 22 carries a liquid wash solution from the wash tank 10 through, in turn, inlet pipe 24, wash filter 26 and inlet pipe 28, and then into the wash header 14. Similarly, a rinse pump 30 carries a liquid rinse solution from the rinse tank 12 through, in turn, inlet pipe 32, rinse filter 34, and inlet pipe 36, and then into the rinse header 18. A control panel 38 is mounted to the wash cabinet 2 and controls the overall operation of the machine.

In accordance with known arrangements, the parts to be washed are positioned on a holder (not shown) inside of the wash cabinet 2 and within the spray areas of the wash header 14 and rinse header 18. The holder would be rotated as high pressure sprays of wash solution and, in turn, rinse solution are directed onto the parts. The machine shown in FIGS. 1 and 2 can also include, as is known in the art, a blower (not shown) for directing heated air into the wash cabinet 2 for drying the washed parts.

After leaving the wash header 14 or rinse header 18, the liquid wash or rinse solutions flow by gravity along the side walls 40, 42 and back wall 44 of the wash cabinet 2 to an angled shed sheet 46 at the bottom of the wash cabinet 2. The shed sheet 46 is angled downwardly from the back wall 44 and toward the front of the wash cabinet 2 and directs liquid flows to a floor 48 of the wash cabinet 2. The cabinet floor 48 includes a recessed, U-shaped trough 50 extending across the front of the wash cabinet 2 and beneath the access opening 4. A bottom wall 52 of the trough 50 includes a wash opening 54 therethrough which is in direct fluid communication with the wash tank 10 located directly therebeneath. Similarly, the trough 50 includes a rinse opening 56 through the bottom wall 52 and in direct fluid communication with the rinse tank 12 located directly therebeneath. A drain opening 58 is provided in the bottom wall 52 of the trough 50 and is connected directly to a drain pipe 60 which extends through one side of the washing machine, as shown through an outer wall of the rinse tank 12, and to an external drain location. A chip strainer 62 or grate can be positioned over and covering an upper, open portion of the trough 50 and generally aligned with the cabinet floor 48.

Figure 6:
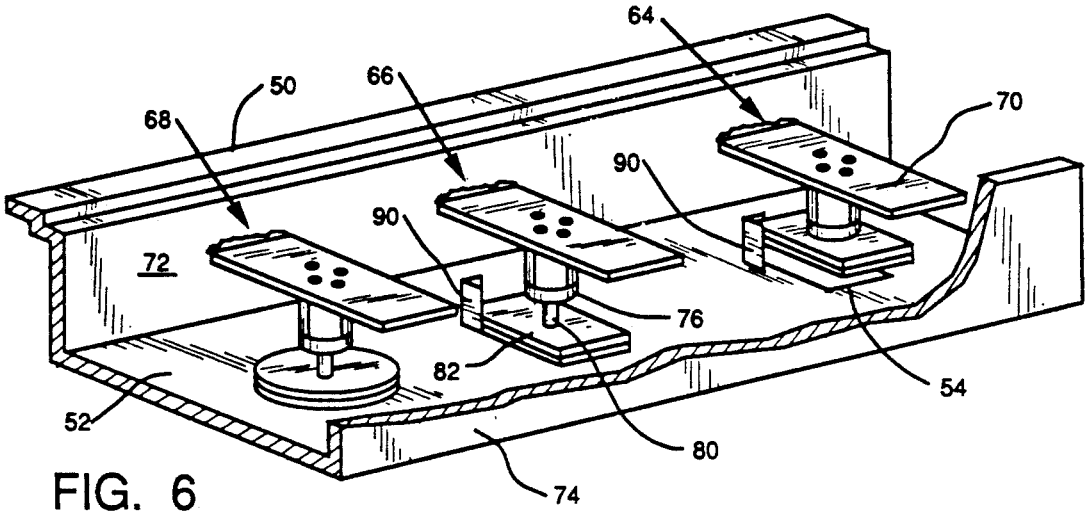
FIG. 6 is a perspective view, partially exposed, of the trough area of the power spray parts washing machine shown in FIGS. 1 and 2.
Figure 7:
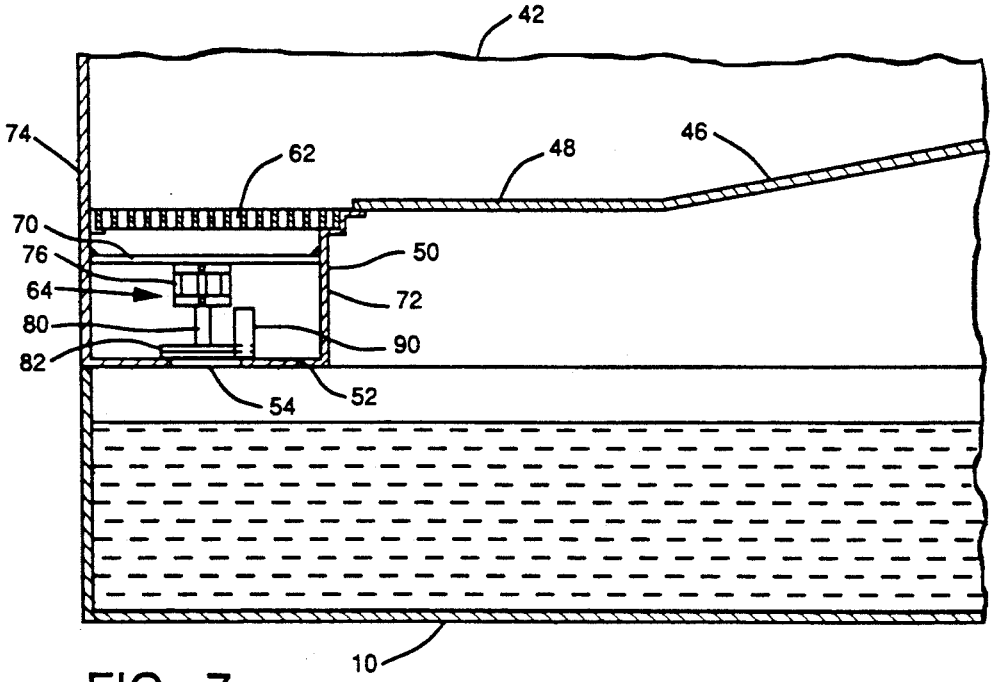
FIG. 7 is a section taken along lines VII—VII in FIG. 1.
Figure 8:
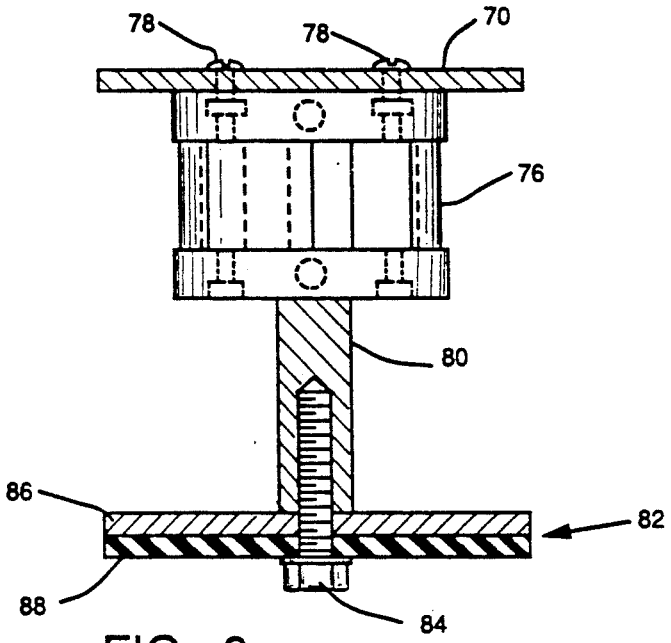
FIG. 8 is a side view, partially in section, of a valve used in the power spray parts washing machine shown in FIGS. 1-7.

In accordance with the present invention, separate vertical, flush face plug valves are positioned within the trough 50, above the bottom wall 52, and provide a flat seal for the wash opening 54, rinse opening 56 and drain opening 58. A wash valve 64 is provided within the trough 50 immediately above the wash opening 54, a rinse valve 66 is positioned within the trough 50 immediately above the rinse opening 56, and a drain valve 68 is positioned within the trough 50 immediately above the drain opening 58. As can be seen in FIGS. 1-7, valves 64, 66 and 68 each have no portion which extends upwardly out of the trough 50 and above the floor 48 of the wash cabinet 2. Each of the valves is similar in construction. Referring particularly to FIG. 8 as well as to FIG. 6, each valve includes a support 70, such as a rectangular metal plate, positioned within the trough 50 above the bottom wall 52 and spaced from an associated opening and attached to opposed sidewalls 72, 74 of the trough 50 by welding or the like. Each valve also includes an actuator, such as a pneumatic cylinder 76, attached by bolts 78 or the like to a lower surface of the support 70 and having a moveable shaft 80 extending downwardly therefrom. A Bimba Series Flat 1, Model No. CFD-03433-A, pneumatic cylinder has been found to be acceptable for the pneumatic cylinder 76. Each valve also includes a valve head 82 attached to an exterior end of the shaft 80 by bolt 84 or the like. Preferably the valve head 82 includes a flat steel plate 86, larger than an associated opening, and coated with a resilient, non-porous material, such as a layer of rubber 88, on a lower face which covers the associated opening. As directed by operation of the pneumatic cylinder 76 and movement of the shaft 80 therein, each valve head 82 is moveable between a closed position in direct contact with and closing the associated opening and an open position out of contact with and uncovering the associated opening. Since a flat valve head 82 is provided, and since the associated openings are connected directly to a solution holding tank or to a drain, when the valves are in the closed position, no liquid is trapped between the floor 48 of the wash cabinet 2 and the associated holding tanks and, therefore, cross contamination between the holding tanks is minimized or eliminated.

The openings, and associated valve heads, can either have various configurations, including a round, square or rectangular configuration, depending on the volume of fluid which must be returned to the particular holding tank or to the direct drain. As shown in the present arrangement, the wash opening 54, the valve head on the wash valve 64, the rinse opening 56, and the valve head on the rinse valve 66 are rectangular in shape, while the drain opening 58 and valve head on the drain valve 68 are circular in shape. In addition, it is preferred that the valves 64, 66 and 68 be positioned within the trough 50 not only for easy access for maintenance, manufacture and the like, but also to position them in a location which does not have constant standing water. As shown in FIGS. 6 and 7, angle guides can be mounted to the bottom wall 52 of the trough 50, at one or more of the corners of the rectangular or square valve heads, and assist in guiding the valve head in its vertical movement between the open and closed positions.

Figure 3:
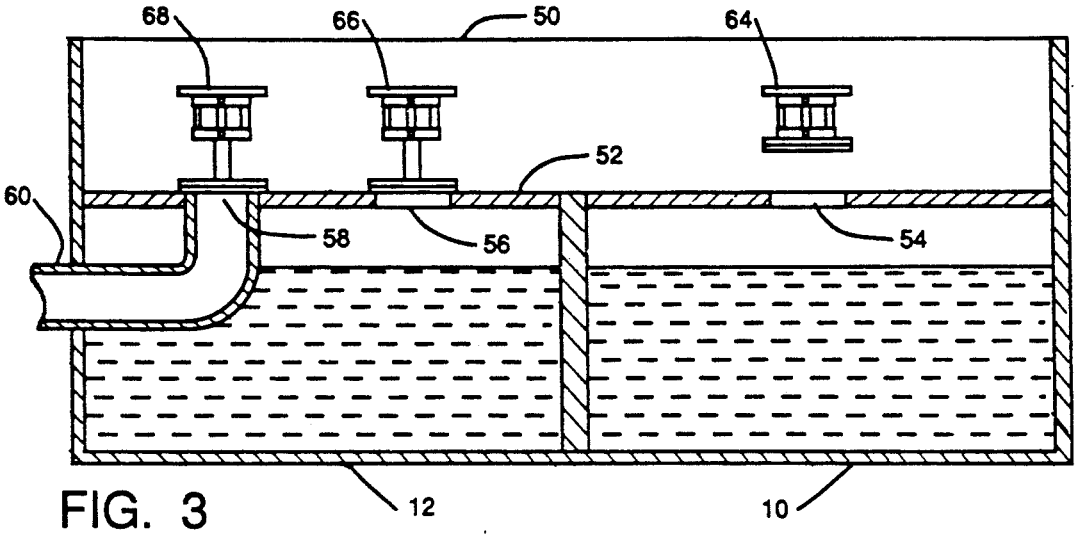
FIG. 3 is a longitudinal section taken along lines III—III in FIGS. 1 and 2, and showing the valves in a first position.
Figure 4:
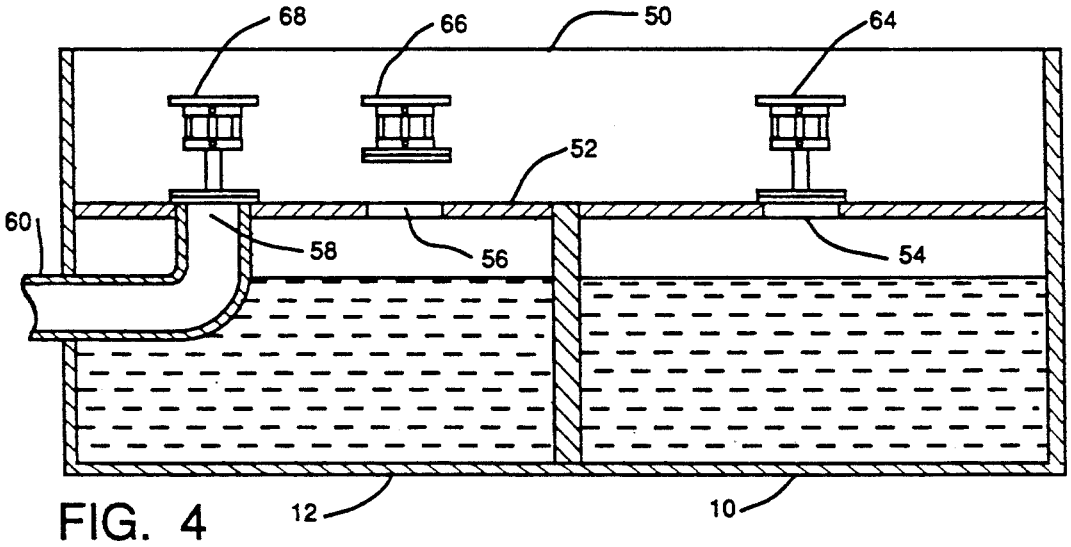
FIG. 4 is a section similar to FIG. 3 and showing the valves in a second position.
Figure 5:
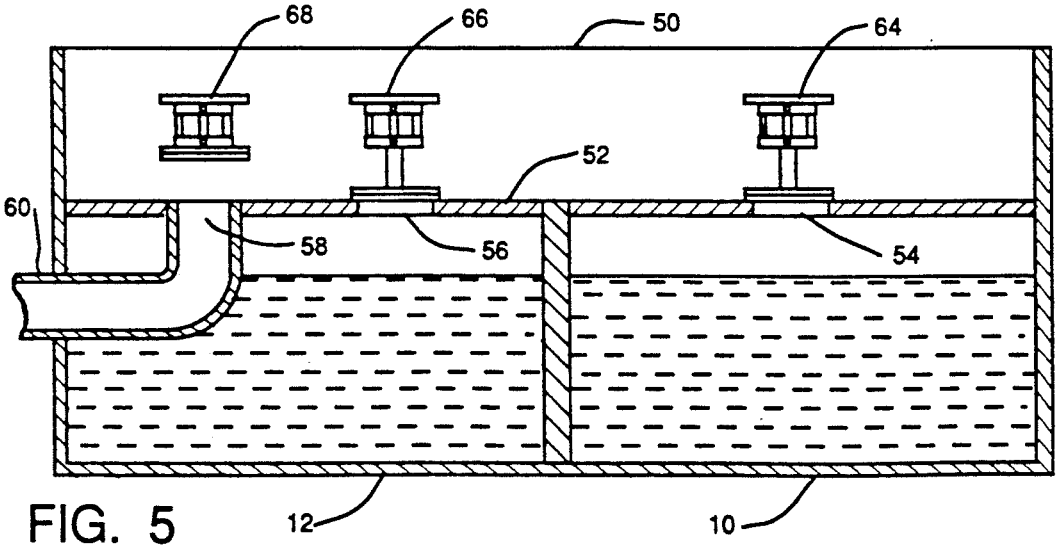
FIG. 5 is a section similar to FIG. 3 and showing the valves in a third position.

The operation of the present invention in a normal wash cycle can be illustrated in connection with FIGS. 3–4. Initially, as shown in FIG. 3, the wash valve 64 is open, uncovering the wash opening 54, and the rinse valve 66 and drain valve 68 are closed, covering the rinse opening 56 and drain opening 58, respectively. The wash solution is pumped from the wash tank 10 through the wash header 14 for a preset period of time to wash parts in the wash cabinet 2 in accordance with known procedures. After the wash pump 22 has been turned off, the wash valve 64 remains open, and the rinse valve 66 and drain valve 68 remain closed, to allow substantially all of the wash solution within the wash cabinet 2 to drain into the trough 50 and, thence, through the wash opening 54 and into the wash tank 10. After a predetermined delay period or drip time, the wash valve 64 will be closed and the rinse valve 66 will be opened. The drain valve 68 remains closed. This configuration of the valves is shown in FIG. 4. Thereafter, the rinse solution is pumped from the rinse tank 12 through the rinse header 18 for a preset period of time to rinse the parts in accordance with known procedures. After the rinse pump 30 has been turned off, the rinse valve 66 remains open, and the wash valve 64 and drain valve 68 remain closed, to allow substantially all of the rinse solution in the wash cabinet 2 to drain, for a predetermined delay period or drip time, into the trough 50 and, thence, into the rinse tank 12 through the rinse opening 56. If it is desired to conduct a further rinse of the parts with clean water or the like, the wash valve 64 remains closed, the rinse valve 66 is closed, and the drain valve 68 is opened. This configuration is shown in FIG. 5. Clean water can be sprayed in the interior of the wash cabinet 2 by known means and the water will be carried to the trough 50, into the drain opening 58 and out of the wash cabinet 2 by the drain pipe 60.

Figure 9:
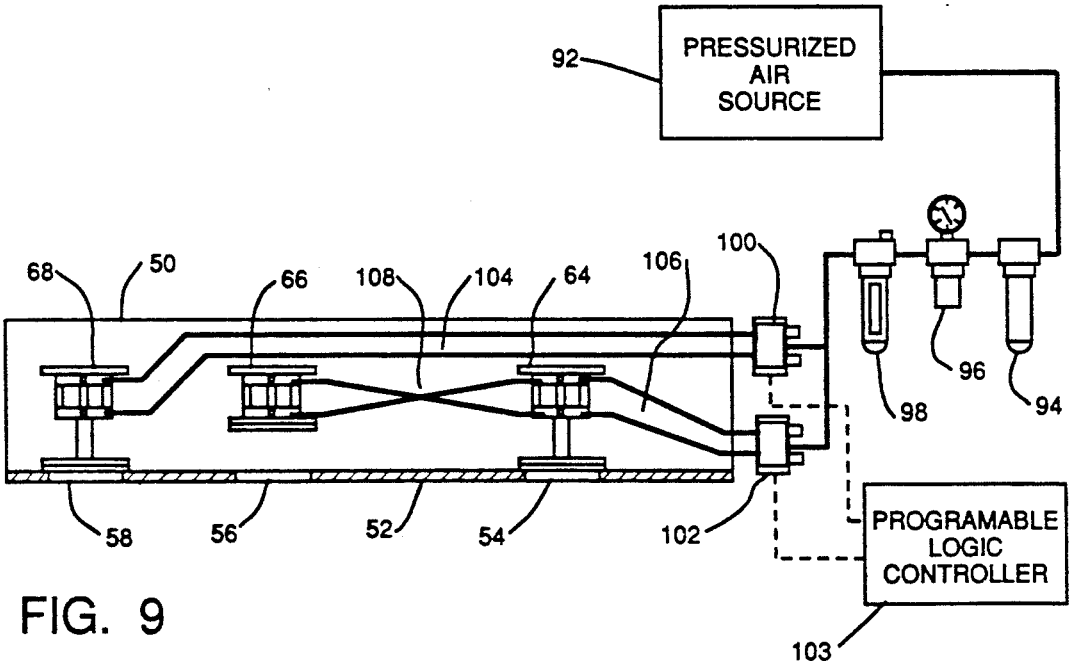
FIG. 9 is a schematic drawing of the air system for controlling the valves in the power spray parts washing machine shown in FIGS. 1-7.

All of the operation of the wash and rinse pumps, including the timing functions, as well as the operation of the wash valve 64, rinse valve 66 and drain valve 68 discussed above, can be controlled by automatic controls contained in the control panel 38. The operation of the wash pump 22 and rinse pump 30 can be controlled by known timer arrangements or the like. Arrangements for controlling the operation of various numbers of valves in the present invention can be explained with reference to FIG. 9. Although the valves are shown as operated by pneumatic actuators, other valve actuation mechanisms can also be known. As shown in FIG. 9, pressurized air is supplied from a pressurized air source 92 to, in turn, an air filter 94, a pressure regulator 96, and a lubricator 98 and, then, to both a first pneumatic solenoid 100 and a second pneumatic solenoid 102. The solenoids 100, 102 are each controlled by a standard programmable logic controller 103. A first pair of pneumatic tubes 104 carries the pressurized air from the first solenoid 100 to the actuator of the drain valve 68. If three or more valves were included in the arrangement, then a separate pneumatic actuator and pneumatic lines would be provided for each valve. If only two valves are included, then a single pneumatic actuator can be used to control the two valves. This later arrangement is shown in FIG. 9 in connection with the wash valve 64 and rinse valve 66. A second pair of pneumatic tubes 106 carries air from the second solenoid 102 to the actuator of the wash valve 64. In addition, a third pair of pneumatic tubes 108, with a reverse configuration from the second pair of pneumatic tubes 106, carries the air from the actuator of the wash valve 64 to the actuator of the rinse valve 66. By providing this reversed configuration, it is assured that the wash valve 64 will always be in an opposite position from the drain valve 66. For example, in the configuration shown in FIG. 9, with the wash valve 64 closed and the rinse valve 66 opened, if a control signal is sent from the programmable logic controller 103 to the second solenoid 102 which changes the state of the second solenoid 102, the wash valve 64 would be opened and the rinse valve 66 would be simultaneously closed. This result comes from using a single pneumatic solenoid to control both the wash valve 64 and the rinse valve 66.

The operation of the various valves is controlled by the programmable logic controller 103, which takes a set wash and/or rinse time and/or drain, and adds a wash drip time, a rinse drip time and a drain drip time, all of which are programmable, to provide correct timing signals for the operation of the valves. Once all of the timers have been programmed, an entire parts cleaning cycle will be carried out after an operator merely presses a cycle start button on the machine.

Having described above the presently preferred embodiments of this invention, it is to be understood that the invention may be otherwise embodied within the scope of the appended claims.

I claim:

1. A power spray washing machine comprising:

a. an enclosed wash cabinet having a floor therein;

b. a first liquid holding tank positioned beneath said wash cabinet;

c. a first spray means for spraying a first liquid within said wash cabinet;

d. a first pump means for pumping said first liquid from said first liquid holding tank into said first spray means and into wash cabinet;

e. a liquid collection trough extending downwardly from said wash cabinet floor;

f. a first opening through a bottom wall of said trough and in direct fluid communication with said first liquid holding tank;

g. a first valve means positioned within said trough and above said first opening for controlling fluid flows through said first opening, with said first valve means including (i) a support positioned within the trough above and spaced from said first opening and attached to opposed sidewalls of said trough, (ii) an actuator attached to a lower surface of said support and having a moveable shaft extending downwardly therefrom, and (iii) a valve head attached to an exterior end of said shaft, with each of said support, actuator, moveable shaft and valve head of said first valve means being totally contained within said trough and having no portion thereof which extends out of said trough, with said first valve head moveable by said actuator between a closed position with said first valve head in direct contact with and closing said first opening and an open position with said first valve head out of contact with an uncovering said first opening, and with said first valve head retaining no fluids between the floor of said wash cabinet and said first liquid holding tank when said first valve head is in said closed position; and h. control means for controlling the operation of said first valve means between said open and closed positions.

2. The power spray washing machine of claim 1 wherein said trough is positioned at a front portion of said wash cabinet.

3. The power spray washing machine of claim 1 wherein said first valve head is a flat plate, larger than said first opening, and coated with a resilient, non-porous material on a lower face thereof which covers said first opening.

4. The power spray washing machine of claim 3 wherein said first valve head is a flat steel plate.

5. The power spray washing machine of claim 3 wherein said resilient, non-porous material is rubber.

6. The power spray washing machine of claim 1 wherein said actuator is a pneumatic cylinder.

7. The power spray washing machine of claim 1 further including a chip strainer positioned above said first valve means and covering an upper portion of said trough.

8. The power spray washing machine of claim 1 further including a second opening through the bottom wall of said trough and in direct fluid communication with a drain conduit, and further including a second valve means positioned within said trough and above said second opening for controlling fluid flows through said second opening, with said second valve means including (i) a support positioned within the trough above and spaced from said second opening and attached to opposed sidewalls of said trough, (ii) an actuator attached to a lower surface of said support and having a moveable shaft extending downwardly therefrom, and (iii) a valve head attached to an exterior end of said shaft, with each of said support, actuator, moveable shaft and valve head of said second valve means being totally contained within said trough and having no portion thereof which extends out of said trough, with said second valve head moveable by said actuator between a closed position with said second valve head in direct contact with and closing said second opening and an open position with said second valve head out of contact with and uncovering said second opening, and with said second valve head retaining no fluids between the floor of said wash cabinet and said second liquid holding tank when said second valve head is in said closed position, and with said control means also controlling the operation of said second valve means between said open and closed positions.

9. The power spray washing machine of claim 1 further including a third opening through the bottom wall of said trough and in direct fluid communication with a drain conduit, and further including a third valve means positioned within said trough and above said third opening for controlling fluid flows through said third opening, with said third valve means including (i) a support positioned within the trough above and spaced from said third opening and attached to opposed sidewalls of said trough, (ii) an actuator attached to a lower surface of said support and having a moveable shaft extending downwardly therefrom, and (iii) a valve head attached to an exterior end of said shaft, with each of said support, actuator, moveable shaft and valve head of said third valve means being totally contained within said trough and having no portion thereof which extends out of said trough, with said third valve head moveable by said actuator between a closed position with said third valve head in direct contact with and closing said third opening and an open position with said third valve head out of contact with and uncovering said third opening, and with said third valve head retaining no fluids between the floor of said wash cabinet and said third liquid holding tank when said third valve head is in said closed position, and with said control means also controlling the operation of said third valve means between said open and closed positions.

10. A power spray washing machine comprising:

a. an enclosed wash cabinet having a floor therein;

b. a first liquid holding tank positioned beneath said wash cabinet;

c. a second liquid holding tank positioned beneath said wash cabinet;

d. a first spray means for spraying a first liquid within said wash cabinet;

e. a second spray means for spraying a second liquid within said wash cabinet;

f. a first pump means for pumping said first liquid from said first liquid holding tank into said first spray means and into said wash cabinet;

g. a second pump means for pumping a second liquid from said second liquid holding tank into said second spray means and into said wash cabinet;

h. a liquid collection trough extending downwardly from said wash cabinet floor;

i. a first opening through a bottom wall of said trough and in direct fluid communication with said first liquid holding tank;

j. a second opening through the bottom wall of said trough and in direct fluid communication with said second liquid holding tank;

k. a first valve means positioned within said trough and above said first opening for controlling fluid flows through said first opening, with said first valve means including (i) a support positioned within the trough above and spaced from said first opening and attached to opposed sidewalls of said trough, (ii) an actuator attached to a lower surface of said support and having a moveable shaft extending downwardly therefrom, and (iii) a valve head attached to an exterior end of said shaft, with each of said support, actuator, moveable shaft and valve head of said first valve means being totally contained within said trough and having no portion thereof which extends out of said trough, with said first valve head moveable by said actuator between a closed position with said first valve head in direct contact with and closing said first opening and an open position with said first valve head out of contact with and uncovering said first opening, and with said first valve head retaining no fluids between the floor of said wash cabinet and said first liquid holding tank when said first valve head is in said closed position;

l. a second valve means positioned within said trough and above said second opening for controlling fluid flows through said second opening, with said second valve means including (i) a support positioned within the trough above and spaced from said second opening and attached to opposed sidewalls of said trough, (ii) an actuator attached to a lower surface of said support and having a moveable shaft extending downwardly therefrom, and (iii) a valve head attached to an exterior end of said shaft, with each of said support, actuator, moveable shaft and valve head of said second valve means being totally contained within said trough and having no portion thereof which extends out of said trough, with said second valve head moveable by said actuator between a closed position with said second valve head in direct contact with and closing said second opening and an open position with said second valve head out of contact with and uncovering said second opening, and with said second valve head retaining no fluids between the floor of said wash cabinet and said second liquid holding tank when said second valve head is in said closed position; and m. control means for controlling the operation of said first and second valve means between said open and closed positions.

11. The power spray washing machine of claim 10 wherein said trough is positioned at a front portion of said wash cabinet.

12. The power spray washing machine of claim 10 wherein the valve heads of said first and second valve means are each a flat plate, larger than an associated first or second opening, and coated with a resilient, non-porous material on a lower face thereof which covers an associated first or second opening.

13. The power spray washing machine of claim 12 wherein said valve heads are each a flat steel plate.

14. The power spray washing machine of claim 12 wherein said resilient, non-porous material is rubber.

15. The power spray washing machine of claim 10 wherein the actuators of said first and second valve means are pneumatic cylinders.

16. The power spray washing machine of claim 10 further including a chip strainer positioned above said first and second valve means and covering an upper portion of said trough.

* * * * *

UNITED STATES PATENT AND TRADEMARK OFFICE

CERTIFICATE OF CORRECTION

PATENT NO. : 5,305,769

DATED : April 26, 1994

INVENTOR(S) : Robert S. Jung

It is certified that error appears in the above-indentified patent and that said Letters Patent is hereby corrected as shown below:

Claim 1 Line 66 Column 6 after "into" insert --said--.

Signed and Sealed this

Twenty-sixth Day of July, 1994

*Attest:*

*Attesting Officer*

BRUCE LEHMAN

*Commissioner of Patents and Trademarks*